US008875911B2

(12) United States Patent
Donnally et al.

(10) Patent No.: US 8,875,911 B2
(45) Date of Patent: Nov. 4, 2014

(54) DRILLING RIG MAST LIFT SYSTEMS AND METHODS

(75) Inventors: Robert B. Donnally, Shanghai (CN); Chunqiao Ren, Shanghai (CN); Xi Lin Liu, Henan (CN); Yan Yu, Shanghai (CN); Peng Yue, Shanghai (CN); Wei Wang, Beijing (CN)

(73) Assignee: National Oilwell Varco, L.P., Houston, TX (US)

( * ) Notice: Subject to any disclaimer, the term of this patent is extended or adjusted under 35 U.S.C. 154(b) by 239 days.

(21) Appl. No.: 13/148,771

(22) PCT Filed: Apr. 20, 2010

(86) PCT No.: PCT/US2010/031661

§ 371 (c)(1),
(2), (4) Date: Nov. 11, 2011

(87) PCT Pub. No.: WO2010/132174

PCT Pub. Date: Nov. 18, 2010

(65) Prior Publication Data

US 2012/0047820 A1 Mar. 1, 2012

Related U.S. Application Data

(60) Provisional application No. 61/177,773, filed on May 13, 2009.

(51) Int. Cl.
*B66C 23/34* (2006.01)
*E21B 15/00* (2006.01)

(52) U.S. Cl.
CPC ..... *E21B 15/00* (2013.01)
USPC ..... 212/176; 212/270; 212/294

(58) Field of Classification Search
USPC ..... 212/270, 175–177, 180, 294–296, 299, 212/306
See application file for complete search history.

(56) References Cited

U.S. PATENT DOCUMENTS

| | | | | |
|---|---|---|---|---|
| 2,253,487 | A | 8/1941 | Claire | |
| 2,690,268 | A | 9/1954 | Woolslayer | |
| 3,295,270 | A | 1/1967 | Woolslayer | |
| 3,747,695 | A * | 7/1973 | Branham | 173/151 |
| 3,922,825 | A | 12/1975 | Eddy | |
| 3,942,593 | A * | 3/1976 | Reeve et al. | 173/186 |
| 4,135,340 | A * | 1/1979 | Cox et al. | 52/115 |
| 4,269,395 | A * | 5/1981 | Newman et al. | 254/386 |

(Continued)

OTHER PUBLICATIONS

Communication relating to the results of the International Search Report from counterpart International Application No. PCT/US10/31661 dated Apr. 20, 2010.

(Continued)

*Primary Examiner* — Emmanuel M Marcelo
*Assistant Examiner* — Michael Gallion
(74) *Attorney, Agent, or Firm* — Amerson Law Firm, PLLC

(57) ABSTRACT

Systems and methods for rig assembly and for erecting a mast of a rig and such systems with roller apparatus to facilitate movement of a mast section from a mover. In a first embodiment, the method includes erecting a rig mast section on a substructure, the substructure including a first substructure box spaced-apart from a second substructure box, the first substructure box comprising a first upper box above a first lower box and the second substructure box comprising a second upper box above a second lower box.

25 Claims, 9 Drawing Sheets

(56) References Cited

U.S. PATENT DOCUMENTS

| | | | | |
|---|---|---|---|---|
| 4,290,495 | A * | 9/1981 | Elliston | 175/85 |
| 4,305,237 | A * | 12/1981 | Borg et al. | 52/116 |
| 4,371,041 | A * | 2/1983 | Becker et al. | 173/28 |
| 4,587,778 | A * | 5/1986 | Woolslayer et al. | 52/116 |
| 4,630,425 | A * | 12/1986 | Reed | 52/745.18 |
| 4,821,816 | A * | 4/1989 | Willis | 175/57 |
| 4,899,832 | A * | 2/1990 | Bierscheid, Jr. | 173/187 |
| 5,425,435 | A * | 6/1995 | Gregory | 188/77 W |
| 6,634,436 | B1 * | 10/2003 | Desai | 173/1 |
| 6,848,515 | B2 * | 2/2005 | Orr et al. | 173/1 |
| 6,962,030 | B2 * | 11/2005 | Conn | 52/741.1 |
| 8,250,816 | B2 * | 8/2012 | Donnally et al. | 52/123.1 |
| 2004/0211572 | A1 * | 10/2004 | Orr et al. | 173/1 |
| 2005/0193645 | A1 * | 9/2005 | Barnes | 52/120 |
| 2011/0072737 | A1 * | 3/2011 | Wasterval | 52/115 |
| 2011/0079568 | A1 * | 4/2011 | Mau et al. | 212/296 |

OTHER PUBLICATIONS

Office Action from Chinese application No. 201080013507.0 dated Jul. 1, 2013.

* cited by examiner

DRILLING RIG MAST LIFT SYSTEMS AND METHODS

CROSS-REFERENCE TO RELATED APPLICATIONS

This is a 371 of PCT/US10/31661, filed Apr. 20, 2010, which claimed priority from U.S. provisional patent application Ser. No. 61/177,773, filed May 13, 2009.

BACKGROUND OF THE INVENTION

1. Field of the Invention

This invention is directed to drilling rigs and to methods for erecting masts for mobile drilling rigs.

2. Description of Related Art

The a wide variety of rigs used in drilling and various wellbore operations are well known, and described, for example, in U.S. Pat. Nos. 3,340,938; 3,807,109; 3,922,825; 3,942,593; 4,269,395; 4,290,495; 4,368,602; 4,489,526; 4,569,168; 4,837,992; 6,634,436; 6,523,319; and 7,306,055. A variety of systems and methods for assembling and erecting a drilling rig are also known; and described for example in U.S. Pat. Nos. 2,993,570; 3,201,091; 3,262,237; 3,749,183; 4,221,088; 4,269,009; 4,292,772; 4,305,237; 4,478,015; 4,587,778; 4,630,425; and 4,932,175.

In many prior rigs and erection methods, rig components and structures used with a rig are raised by a crane and positioned on a rig's drill floor. Various problems and disadvantages are associated with using a crane. A crane is typically a large apparatus which is transported to a drilling site where it is assembled and/or made ready for lifting and locating rig components.

In addition, rig erection structures, apparatuses, and methods are disclosed in pending U.S. Applications co-owned with the present invention: U.S. application Ser. Nos. 12/074,258; 12/074,264; 12/074,232; and 12/074,270 all filed Feb. 29, 2008 and pending U.S. application Ser. No. 12/069,913 filed Feb. 13, 2008; Ser. No. 12/152,651 filed May 15, 2008; and Ser. No. 11/906,147 filed Sep. 28, 2007.

In certain known rig assembly methods, there is no clear path for a vehicle (e.g. a truck/trailer used for transporting a mast section) into or through the center of a rig substructure during rig assembly. Also, in certain known rig assembly methods, a mast (or part of it) cannot be brought to the substructure at normal truck height and the mast cannot be connected directly to the substructure from a truck. These problems are made worse when there is an obstruction, e.g. a relatively large well head or cellar, at well center in the path through the substructure. These deficiencies render these known rig assembly methods complex, inefficient, and time-consuming.

BRIEF SUMMARY OF THE INVENTION

The present invention, in certain aspects, provides a system and a method for erecting a rig mast section on a substructure, the substructure including a first substructure box spaced-apart from a second substructure box, the first substructure box including a first upper box above a first lower box and the second substructure box including a second upper box above a second lower box, each upper box having an upper roller or rollers and each lower box having a lower roller or rollers, the method including: moving a mast section on a mover to a position adjacent the substructure; connecting a winch line of a winch apparatus to the mast section; winching with the winch apparatus the mast section rearward on rollers so that part of the mast section moves over so that it is not above the mover; backing the mover to locate this part of the mast section over the upper rollers; and raising with upper box raising apparatus the upper boxes so that the upper rollers contact the mast section and so that the rear part of the mast section is lifted off the mover. The method then proceeds with moving the mast section completely from the mover.

The present invention discloses, in certain aspects, a mast erection apparatus including: a substructure with a first substructure box and a second substructure box; the first substructure box including a first upper box above a first lower box; the second substructure box including a second upper box above a second lower box; each upper box having upper roller apparatus; each lower box having lower roller apparatus; the lower roller apparatuses located for supporting a mast section movable onto the lower roller apparatuses from a mover; and the upper roller apparatuses located for supporting a mast section movable onto the upper roller apparatuses from a mover. In one such mast erection apparatus, each lower roller apparatus and each upper roller apparatus is pivotably connected to a corresponding box for pivoting between a first position (e.g. for transport) and a second position for facilitating movement of a mast section from a mover.

The present invention discloses, in certain aspects, a mast section with mast roller apparatus for facilitating movement of the mast section on a mover; the mast section, in one aspect, having the mast roller apparatus releasably connected to the mast section and/or on a mover.

Accordingly, the present invention includes features and advantages which are believed to enable it to advance drilling rig technology and rig mast transfer and erection technology. Characteristics and advantages of the present invention described above and additional features and benefits will be readily apparent to those skilled in the art upon consideration of the following description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions of embodiments preferred at the time of filing for this patent that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

Disclosed herein are new, useful, unique, efficient, nonobvious drilling rigs; rig erection methods; and new, useful, unique, efficient, nonobvious mover and rig structures for rig mast erection. Also disclosed are systems and methods in which a mast section is unloadable from a mover onto a substructure at a normal vehicle height;

Such systems and methods may include a rig substructure which is positionable so that a clear path into the substructure is accessible during rig assembly and erection.

Such systems may include a substructure having box(es) with roller(s) to facilitate movement of a mast section from a mover; and a mast section with roller apparatus for facilitating movement of the mast section.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

It will be understood that the various embodiments of the present invention may include one, some, or all of the disclosed, described, and/or enumerated improvements and/or technical advantages and/or elements in claims to this invention.

Certain aspects, certain embodiments, and certain preferable features of the invention are set out herein. Any combination of aspects or features shown in any aspect or embodiment can be used except where such aspects or features are mutually exclusive.

BRIEF DESCRIPTION OF THE DRAWINGS

A more particular description of embodiments of the invention briefly summarized above may be had by references to the embodiments which are shown in the drawings which form a part of this specification. These drawings illustrate embodiments preferred at the time of filing for this patent and are not to be used to improperly limit the scope of the invention which may have other equally effective or legally equivalent embodiments.

Figure 1:
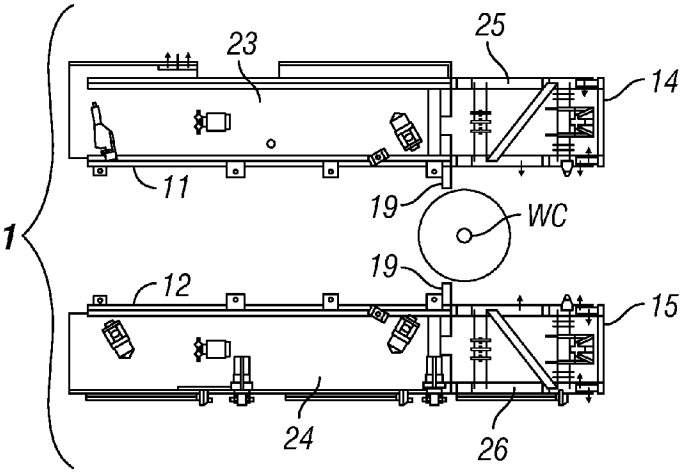
FIG. 1 is a top view of a rig according to the present invention.

Certain embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of certain embodiments and are not intended to limit the invention or the appended claims. On the contrary, the intention is to cover all modifications, equivalents and alternatives falling within the spirit and scope of the invention as defined by the appended claims. In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims.

DETAILED DESCRIPTION OF THE INVENTION

As shown in FIG. 1 two substructure side boxes 11, 12 of a rig according to the present invention are positioned with respect to a well center WC. In one aspect the substructure side box 11 is an Off-Drillers Side substructure side box and the substructure side box 12 is a Drillers Side substructure side box. The side box 11 has an upper box 23 and a lower box 25. The side box 12 has an upper box 24 and a lower box 26.

Figure 2:
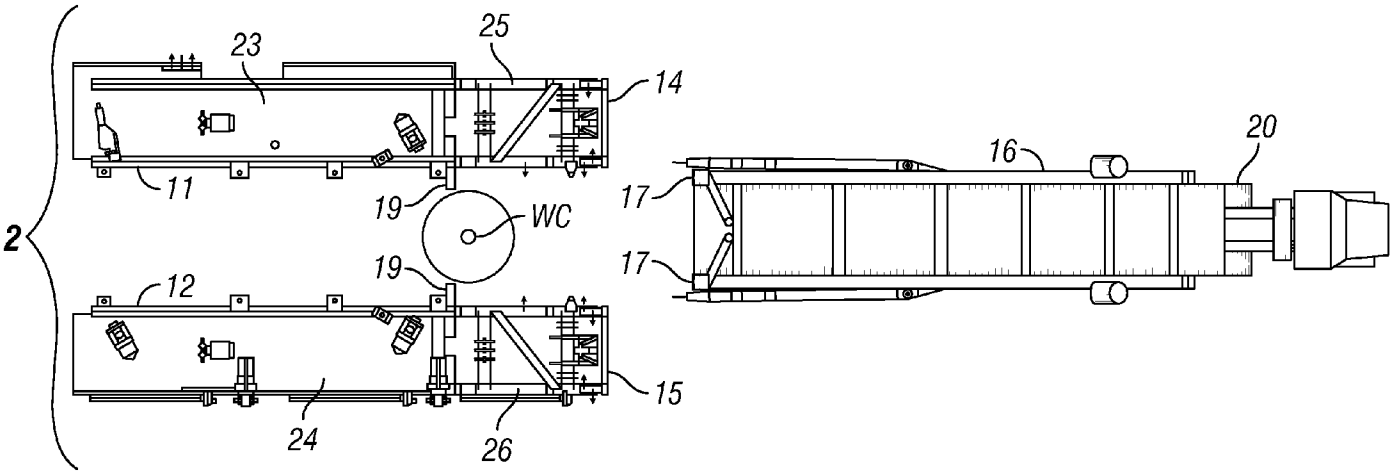
FIG. 2 is a top view of the rig of FIG. 1 and of a truck with a mast section.

FIG. 2 illustrates the backing and the orienting of a truck 20 towards fronts 14, 15 of the substructure side boxes ("base boxes") 11, 12, respectively. The truck 20 (a "mover") carries a bottom mast section 16 with its feet 17 at the rear of the truck 20. In one aspect the truck 20 includes a cab/engine 20*a* which pulls a trailer 20*b* that supports the mast section 16. The truck 20 and the bottom mast section 16 are aligned with the well center.

Figure 3:
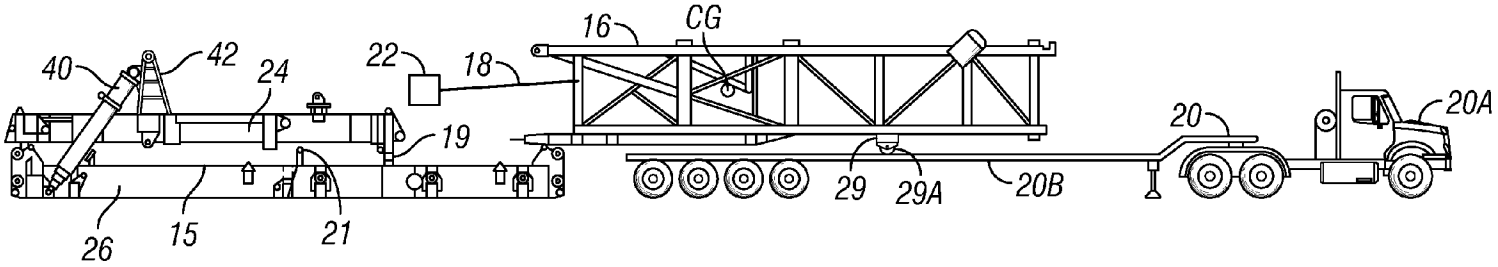
FIG. 3 is a side view of the rig of FIG. 1 and the truck of FIG. 1 in a step of a method according to the present invention.

As shown in FIG. 3, a winch line 18 of a winch apparatus 22 (shown schematically in FIG. 3) is attached to the mast bottom section 16 and the mast bottom section is pulled rearward (e.g. a few feet) so that the mast bottom section overhangs the rear of the trailer 20*b*.

Figure 4:
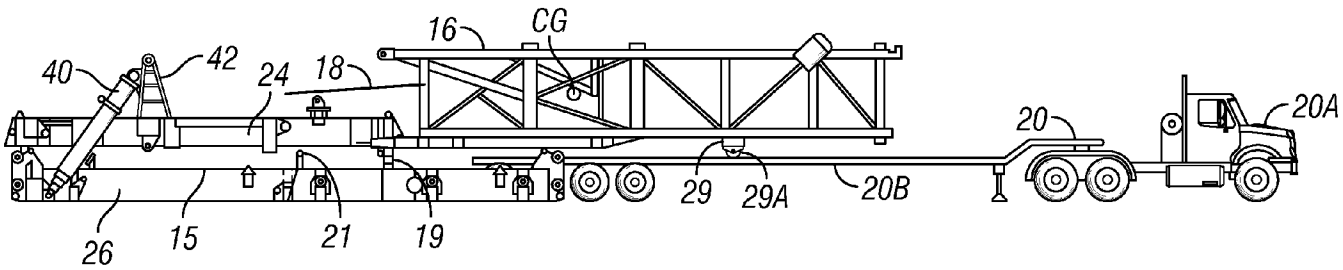
FIG. 4 is a side view of the rig and truck of FIG. 3 showing a step after the step of FIG. 3.

As shown in FIG. 4 the truck 20 is backed up further until part of the mast bottom section 16 is located over roller apparatuses 19 on the upper boxes 23, 24, respectively.

Figure 5:
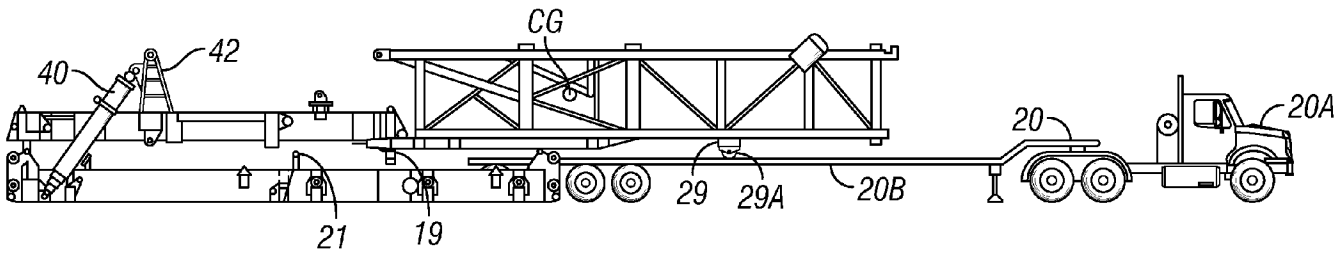
FIG. 5 is a side view of the rig and truck of FIG. 4 showing a step after the step of FIG. 4.

As shown in FIG. 5, the upper boxes 23, 24 are each raised by a powered cylinder apparatus 40, one each connected to a mast shoe 42 and connected to an upper box 23, 24, until the roller apparatuses 19 contact the mast bottom section 16 and then lift the rear portion of the mast bottom section 16 off the trailer 20*b*. The mast bottom section 16, as shown in FIG. 5, is supported by the roller apparatuses 19 and a support roller structure 29 with rollers 29*a* on the mast section. Optionally, the truck (or other mover, vehicle or trailer) can, according to the present invention, have a roller or rollers on which the mast section is movable.

Figure 6:
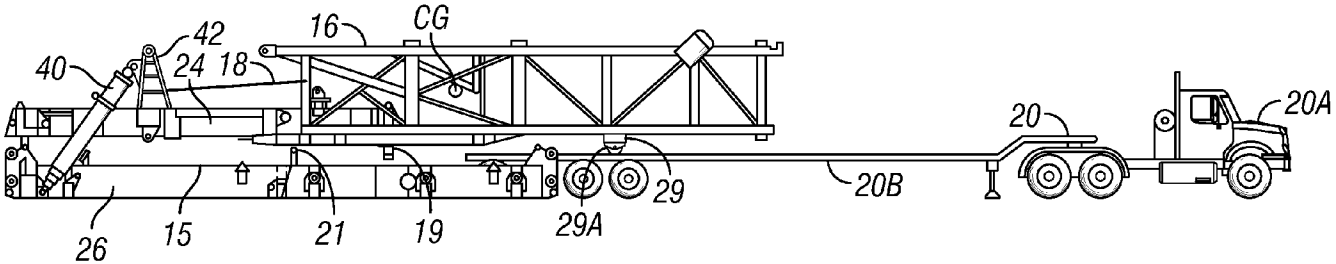
FIG. 6 is a side view of the rig and truck of FIG. 5 showing a step after the step of FIG. 5.
Figure 7:
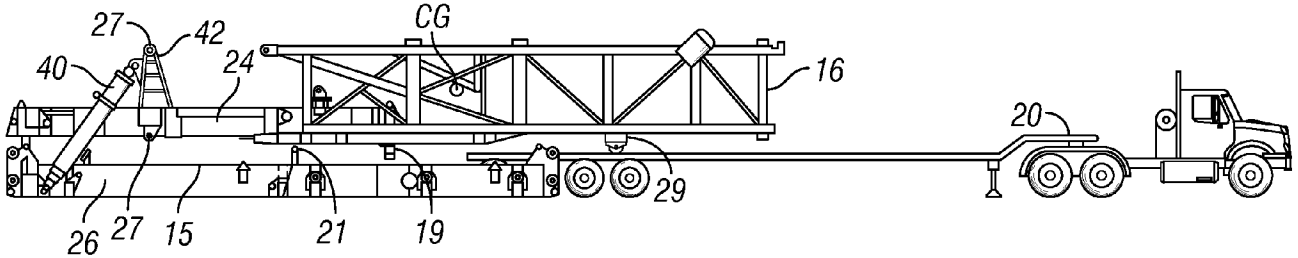
FIG. 7 is a side view of the rig and truck of FIG. 6 showing a step after the step of FIG. 6.

As shown in FIG. 6, the mast bottom section 16 is winched further rearward until it is over roller apparatuses 21 on the lower boxes 25, 26. FIG. 7 illustrates lowering of the upper boxes 23, 24 using the apparatuses 40 so the mast bottom section 16 rests on the roller apparatuses 21 on each base box (and also on the apparatuses 19 and rollers 29*a*).

Figure 8:
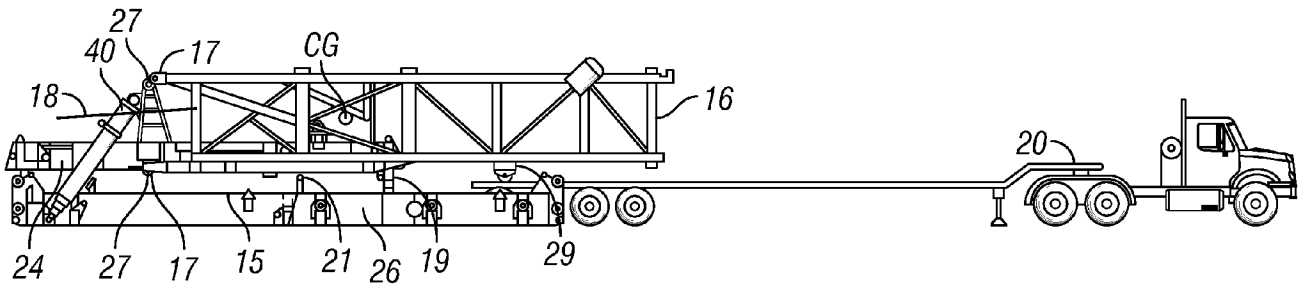
FIG. 8 is a side view of the rig and truck of FIG. 7 showing a step after the step of FIG. 7.
Figure 9:
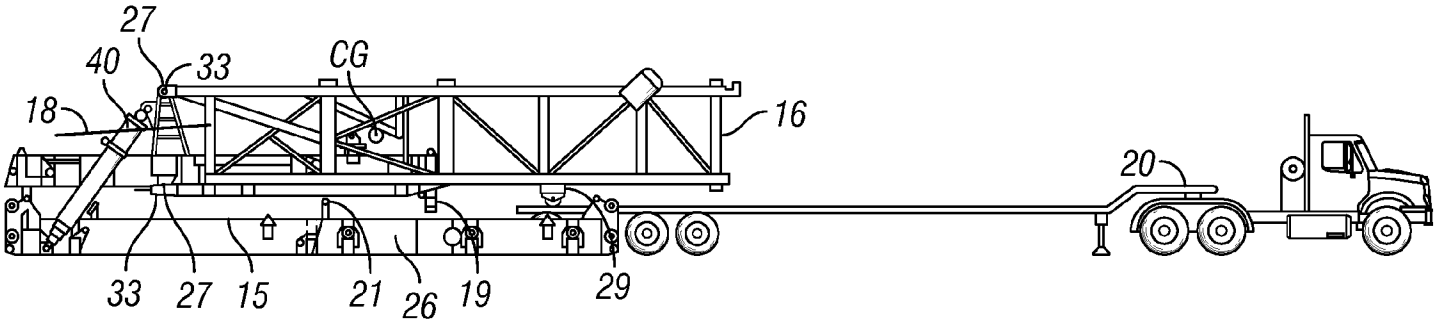
FIG. 9 is a side view of the rig and truck of FIG. 8 showing a step after the step of FIG. 8.

As shown in FIG. 8, the mast bottom section is winched rearward, moving on rollers, until the mast feet 17 align with mast shoes 24, one each on each upper box 23, 24. As shown in FIG. 9, pins 33 are inserted to connect the mast feet 17 to the mast shoes 42.

Figure 10:
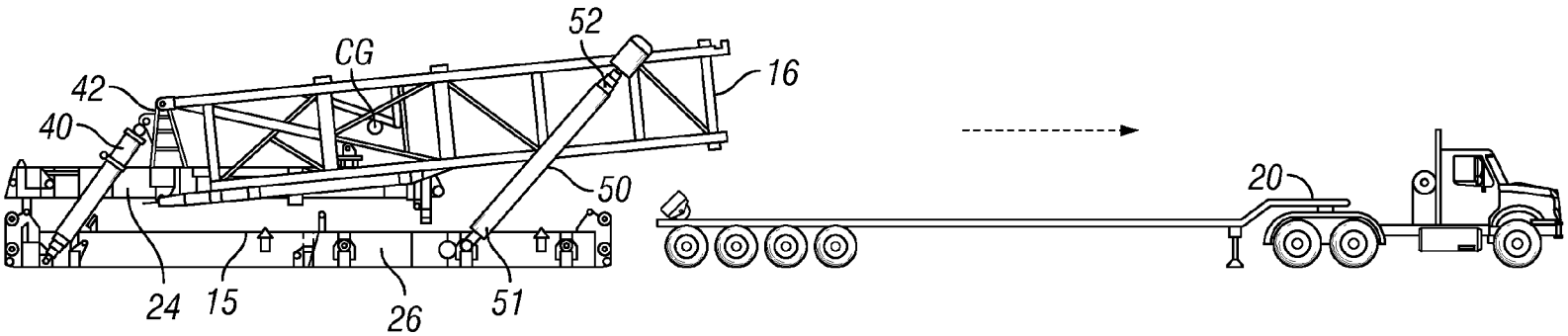
FIG. 10 is a side view of the rig and truck of FIG. 9 showing a step after the step of FIG. 9.

FIG. 10 illustrates raising the mast section 16 above the truck 20. Mast raising cylinders 50, aligned with the mast shoes 42, extend to lift the mast section 16 off the truck 20. The truck 20 is then moved away. A first end 51 of the cylinders 50 is connected to a lower box and a second end 52 is connected to the mast section 16. Each lower box has a cylinder 50 attached to it (one shown in FIG. 10). FIG. 10 illustrates optional roller apparatuses 20*r* on the trailer 20*b* for facilitating movement of a mast section, with or without rollers 29*a*.

As shown in FIGS. 3-10, a center of gravity CG of the mast section 16 is, preferably, always maintained in position so that the mast section 16 is supported in a stable fashion.

FIGS. 11A-16D illustrate various parts and views of the rig and truck of FIGS. 1-10.

As shown in FIGS. 11A, 11C, 11E, 12A, and 12B, the roller apparatuses 19 on the upper boxes 23, 24 are supported on roller supports 61. Optionally (and as shown), the roller supports 61 are pivotably connected to the upper boxes 23, 24 so that the roller supports 61 pivot on the upper boxes 23, 24 to pivot the rollers from one position to another.

Figure 11A:
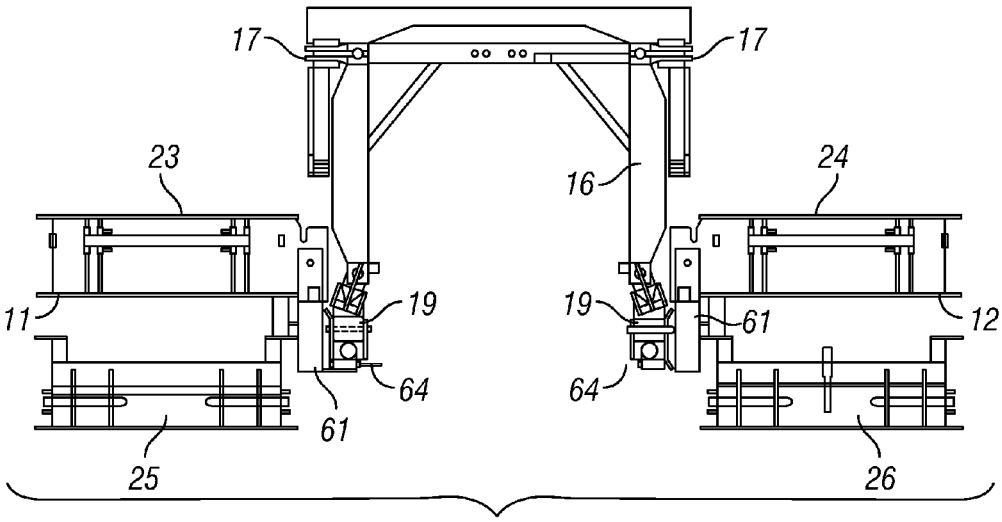
FIG. 11A is an end view of parts of a rig of FIG. 1.
Figure 11B:
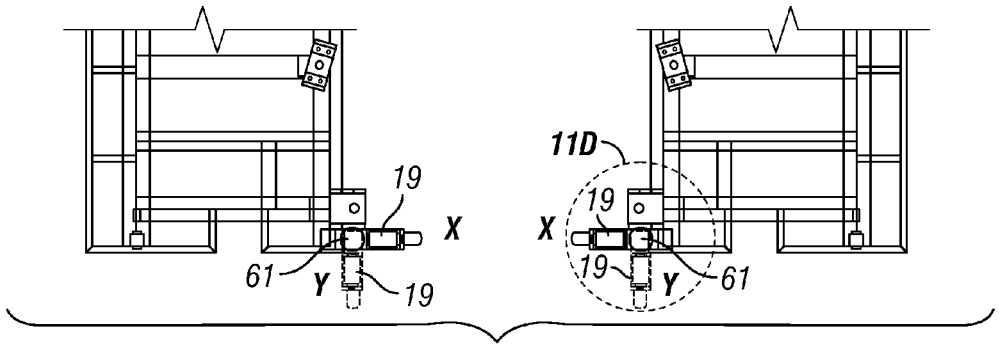
FIG. 11B is a top view of the rig of FIG. 11A.
Figure 11C:
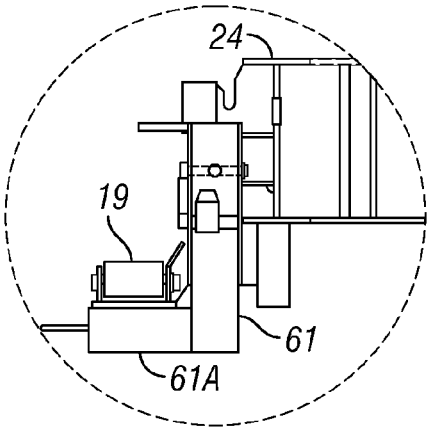
FIG. 11C is an enlarged view of part of the rig as shown in FIG. 11A.
Figure 11D:
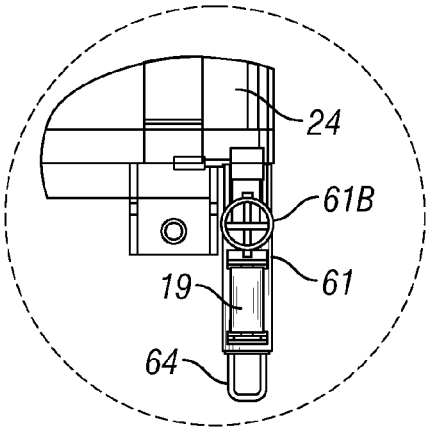
FIG. 11D is an enlarged top view of part of the rig as shown in FIG. 11B.
Figure 11E:
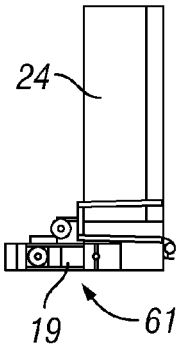
FIG. 11E is a top view showing rollers of an upper box of the rig of FIG. 11A.
Figure 12A:
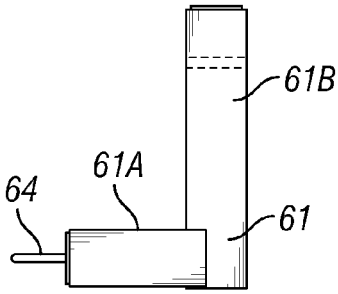
FIG. 12A is an end view of a roller support of the rig as shown in FIG. 11A.
Figure 12B:
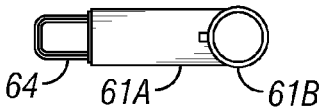
FIG. 12B is a top view of the roller support of FIG. 12A.

FIG. 11B illustrates each roller 19 in each of two possible positions, X (folded inwardly, in an in-use, working position) and Y (folded outwardly or up, e.g. during transport of the structure). Thus the rollers 19 (and those on the lower boxes) facilitate movement of mast sections and can support the load of a mast section. A handle 64 facilitates movement of the rollers from one position to another. Each roller support 61 has a base 61*a* supporting a roller apparatus 19 (see, FIGS. 12A, 12B) and a vertical part 61*b*.

Figure 13A:
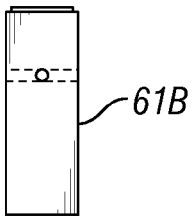
FIG. 13A is a side view of a roller support of the rig of FIG. 1.
Figure 13B:
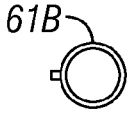
FIG. 13B is a top view of a roller support of the rig of FIG. 13A.

FIGS. 13A and 13B show a part 61*b* of the roller supports 61.

Figure 14A:
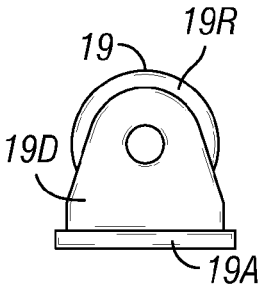
FIG. 14A is an end view of a roller structure of the rig as shown in FIG. 11A.
Figure 14B:
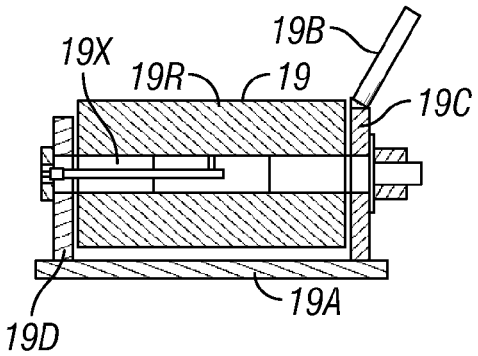
FIG. 14B is a side view of the roller structure of FIG. 14A.
Figure 14C:
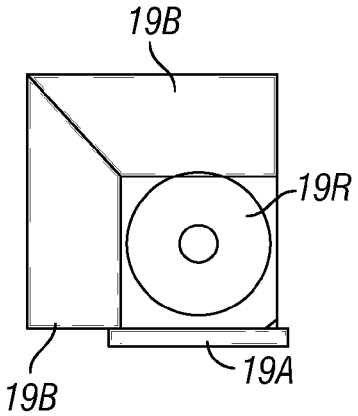
FIG. 14C is an end view, opposite the end view of FIG. 14A.

FIGS. 14A-14C show a roller 19*r* rotatable on an axle 19*x* on a base 19*a*. Flared parts 19*b* project from a side 19*c* on the base 19*a*. Another side 19*d* is spaced-apart from the side 19*c*.

Figure 15A:
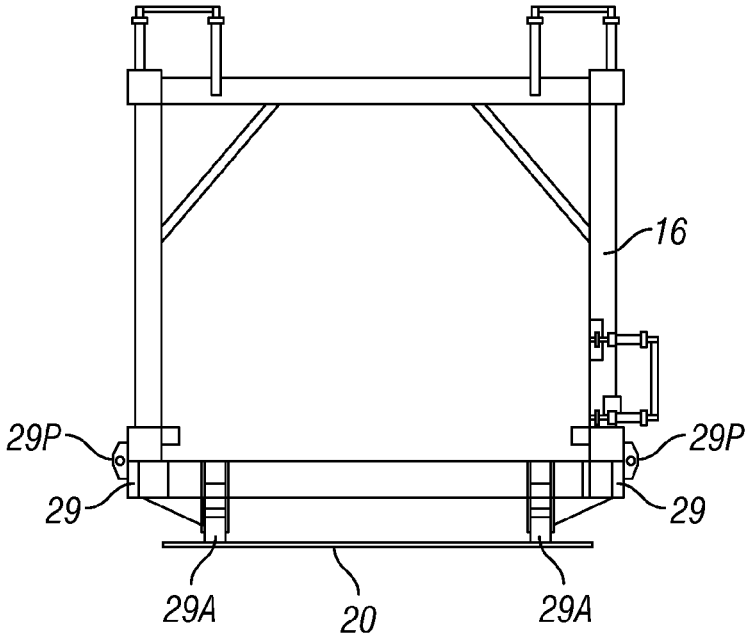
FIG. 15A is a cross-section view of the mast section of the rig of FIG. 2.
Figure 15B:
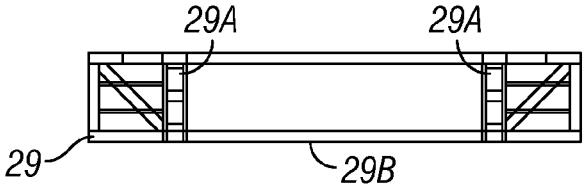
FIG. 15B is a top view of the part of the mast section shown in FIG. 15A.
Figure 15C:
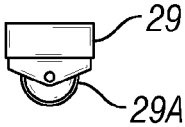
FIG. 15C is a side view of a roller structure on the mast section of FIG. 15A.
Figure 16A:
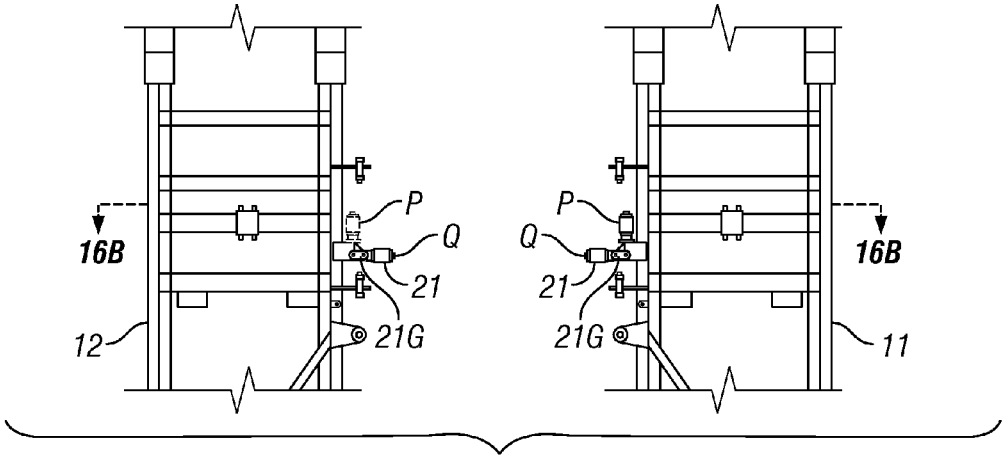
FIG. 16A is a top view showing base box rollers of the rig of FIG. 11A.
Figure 16B:
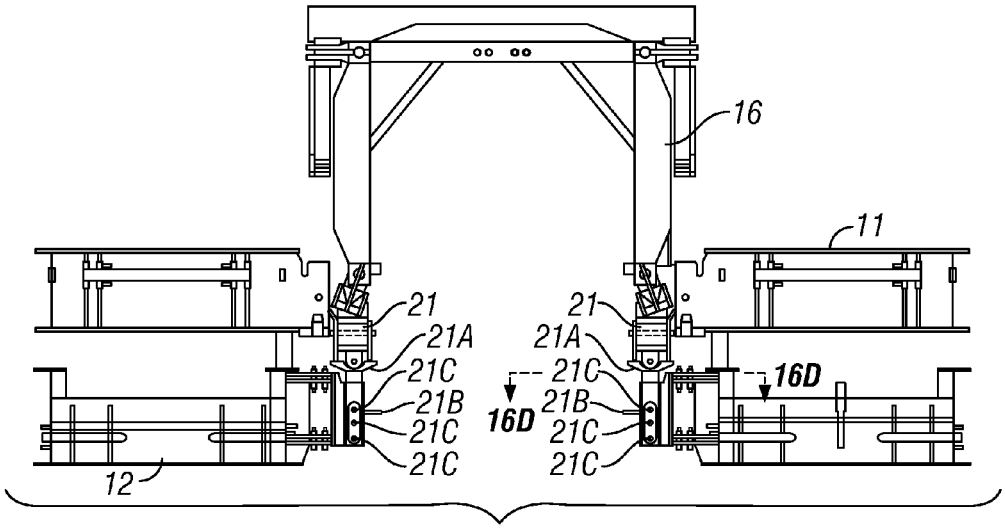
FIG. 16B is an end view of the structure shown in FIG. 16A.
Figure 16C:
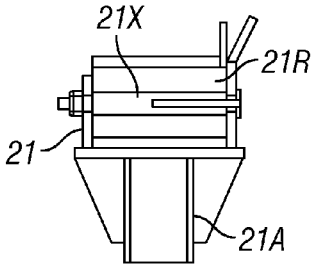
FIG. 16C is an enlargement of part of the rollers on the base boxes as shown in FIG. 16B.
Figure 16D:
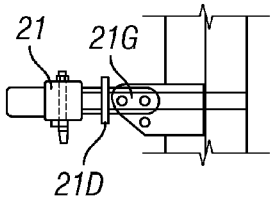
FIG. 16D is a cross-section view along line 16D-16D of FIG. 16B.

FIG. 15A-15C illustrates the support roller structure 29 on the mast section 16 with rollers 29*a*. The rollers 29*a* are rotatably mounted to a base 29*b*. Pins 29*p* releasably connect the support roller structure 29 to the mast section 16.

FIGS. 16A-16D illustrate the roller apparatuses 21 on the base boxes. Supports 21*a* support rollers 21*r* rotatable on an axle 21*x*. Pins 21*b* and holes 21*c* provide height adjustability for the roller supports 21*a*. Optionally, each roller apparatus 21 has a base 21*d* pivotably connected with a pivotal connection zig to a base box so that the roller apparatuses 21 are movable from an operable position Q (directed inwardly, working position) to a "folded" position P, e.g. for transport of the structure (both positions illustrated in FIG. 16A).

The present invention discloses, in at least certain embodiments, a method for erecting a rig mast section on a substructure, the substructure including a first substructure box spaced-apart from a second substructure box, the first substructure box including a first upper box above a first lower box and the second substructure box including a second upper box above a second lower box, each upper box having upper roller apparatus and each lower box having lower roller apparatus, the method including: moving a mast section on a mover (e.g., but not limited to, a truck with a trailer, the mast section on the trailer) to a position adjacent the substructure; connecting a winch line of a winch apparatus to the mast section; winching with the winch apparatus the mast section rearward so that part of the mast section overhangs the mover; backing the mover to locate a part of the mast section over the upper roller apparatuses; and raising with upper box raising apparatus the upper boxes so that the upper roller apparatuses contact the mast section and so that the part of the mast section is lifted off the mover. Such a method may include one, some or a majority of the following (in any possible combination): wherein upon lifting of the part of the mast section, the mast section is supported by the upper roller apparatuses and mast roller apparatus; wherein the mast roller apparatus is on the mast section; wherein the mast roller apparatus is on the mover; winching the mast section further away from the mover to locate part of the mast section over the lower roller apparatuses, and lowering the upper boxes so that the mast section rests on the lower roller apparatuses; wherein the mast section has mast feet and the substructure has mast shoes, the method further including winching the mast section to align the mast feet with the mast shoes, and connecting the mast feet to the mast shoes; wherein the mover includes a truck and a trailer, the trailer connected to the truck, the trailer initially supporting the mast section, and the method further including raising the mast section off the trailer with mast raising apparatus, and moving the truck with the trailer away from the substructure; wherein the mast roller apparatus is initially releasably connected to the mast section, the method further including releasing the mast roller apparatus from the mast section; wherein the mast raising apparatus is releasably connected to the mast section; wherein an obstruction is between the substructure boxes, a top of the obstruction at a first height, the method further including raising the upper boxes to a second height, the second height higher than the first height, so that the obstruction does not impede transfer of the rig mast section; wherein the substructure is at a ground level and the mover moves at ground level to the position adjacent the substructure; wherein the mast section has a center of gravity, the method further including during transfer of the mast section from the mover, maintaining the center of gravity in a position so that the mast section is stable; wherein each upper roller apparatus is pivotably connected to it corresponding box, the method further including initially positioning the upper roller apparatuses in a first position, and then pivoting the upper rollers to a second position for facilitating movement of and/or for supporting the mast section; and/or wherein a well center is within the substructure and the mast section is moved above the well center.

The present invention discloses, in at least certain embodiments, a method for erecting a rig mast section on a substructure, the substructure including a first substructure box spaced-apart from a second substructure box, the first substructure box having a first upper box above a first lower box and the second substructure box having a second upper box above a second lower box, each upper box having upper roller apparatus and each lower box having lower roller apparatus, the method including: moving a mast section on a mover to a position adjacent the substructure; connecting a winch line of a winch apparatus to the mast section; winching with the winch apparatus the mast section rearward so that part of the mast section overhangs the mover; backing the mover to locate a part of the mast section over the upper roller apparatuses, raising with upper box raising apparatus the upper boxes so that the upper roller apparatuses contact the mast section and so that the part of the mast section is lifted off the mover, wherein upon lifting of the rear part of the mast section, the mast section is supported by the upper roller apparatuses and mast roller apparatus; winching the mast section further away from the mover to locate part of the mast section over the lower roller apparatuses; lowering the upper boxes so that the mast section rests on the lower roller apparatus; wherein the mast section has mast feet and the substructure has mast shoes, the method further including winching the mast section to align the mast feet with the mast shoes; connecting the mast feet to the mast shoes; wherein the mover includes a truck and a trailer, the trailer connected to the truck, the trailer initially supporting the mast section, and the method further includes raising the mast section off the trailer with mast raising apparatus, and moving the truck with the trailer away from the substructure.

The present invention discloses, in at least certain embodiments, a mast erection apparatus including: a substructure, the substructure having a first substructure box, a second substructure box spaced-apart from the first substructure box, the first substructure box having a first upper box above a first lower box, the second substructure box having a second upper box above a second lower box, each upper box having upper roller apparatus, each lower box having lower roller apparatus, the lower roller apparatuses located for supporting a mast section movable onto the lower roller apparatus from a mover, and the upper roller apparatuses located for supporting a mast section movable onto the upper roller apparatuses from a mover. Such a mast erection may have one, some or a majority of the following (in any possible combination): each lower roller apparatus and each upper roller apparatus pivotably connected to a corresponding box for pivoting between a first position and a second position for facilitating mast section movement and/or for supporting a mast section; mast roller apparatus for facilitating movement of the mast section on a mover; the mast roller apparatus optionally releasably connected to the mast section; and/or a winching apparatus associated with the substructure for winching the mast section from the mover, box raising apparatus for raising the upper boxes, and mast raising apparatus for raising the mast section.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or and/or to all equivalent elements or steps.

The invention claimed is:

1. A method for erecting a rig mast section on a substructure, the substructure comprising a first substructure box that is positioned laterally adjacent to and spaced-apart from a second substructure box, the first substructure box comprising a first upper box that is raisable above a first lower box and the second substructure box comprising a second upper box that is raisable above a second lower box, each of the first and second upper boxes having an upper roller apparatus coupled thereto and each of the first and second lower boxes having a lower roller apparatus coupled thereto, the method comprising positioning a mast section on a mover, moving the mast section with the mover to a position adjacent the substructure, after positioning the mast section on the mover, moving the mast section relative to the mover, positioning a lower end of the mast section over each of the upper roller apparatuses, and after positioning the lower end of the mast section over each of the upper roller apparatuses, raising each of the first and second upper boxes above the respective first and second lower boxes so that each of the upper roller apparatuses contact the mast section and lift the lower end of the mast section off the mover.

2. The method of claim 1 wherein upon lifting the lower end of the mast section off the mover, the mast section is supported by the upper roller apparatuses and a mast roller apparatus.

3. The method of claim 2 wherein the mast roller apparatus rollingly supports an upper end of the mast section as the mast section is moved relative to the mover.

4. The method of claim 2 further comprising, after lifting the lower end of the mast section off the mover, rolling the mast section on the upper roller apparatuses so as to further move the mast section relative to the mover and position the lower end of the mast section over the lower roller apparatuses, and thereafter lowering the upper boxes so that the mast section rests on the lower roller apparatuses.

5. The method of claim 4 wherein the mast section has mast feet and the substructure has mast shoes, the method further comprising moving the mast section along the substructure by rolling the mast section on the upper and lower roller apparatuses so as to align the mast feet with the mast shoes, and thereafter connecting the mast feet to the mast shoes.

6. The method of claim 5 wherein the mover includes a truck and a trailer, the trailer connected to the truck, the trailer initially supporting the mast section, the method further comprising, after connecting the mast feet to the mast shoes, raising the mast section off the trailer with mast raising apparatus, and moving the truck with the trailer away from the substructure.

7. The method of claim 6 wherein the mast roller apparatus is initially releasably connected to the mast section, the method further comprising releasing the mast roller apparatus from the mast section.

8. The method of claim 6 wherein the mast raising apparatus is releasably connected to the mast section.

9. The method of claim 1 further comprising raising the first and second upper boxes to a height that provides a clearance between the mast section and a wellhead structure positioned between the first and second substructure boxes so that the wellhead structure does not impede transfer of the mast section from the mover to the substructure.

10. The method of claim 9 wherein the substructure is at a ground level and the mover moves at ground level to the position adjacent the substructure.

11. The method of claim 1 wherein the mast section has a center of gravity, the method further comprising, during transfer of the mast section from the mover, maintaining the center of gravity in a position so that the mast section is stable.

12. The method of claim 1 wherein each upper roller apparatus is pivotably coupled to a respective one of said first and second upper boxes, the method further comprising initially positioning the upper roller apparatuses in a first position and thereafter pivoting the upper rollers to a second position for supporting the mast section.

13. The method of claim 1 wherein a well center is positioned between the laterally adjacent and spaced-apart first and second substructure boxes and the mast section is moved above the well center.

14. A method for erecting a rig mast section on a substructure, the substructure comprising a first substructure box that is positioned laterally adjacent to and spaced-apart from a second substructure box, the first substructure box comprising a first upper box that is raisable above a first lower box and the second substructure box comprising a second upper box that is raisable above a second lower box, each of the first and second upper boxes having an upper roller apparatus pivotably coupled thereto and each of the first and second lower boxes having a lower roller apparatus pivotably coupled thereto, the method comprising positioning a mast section on a mover, moving the mast section with the mover to a position adjacent the substructure, after positioning the mast section on the mover, moving the mast section relative to the mover, positioning a lower end of the mast section over each of the upper roller apparatuses, after positioning the lower end of the mast section over each of the upper roller apparatuses and between the first and second upper boxes, raising each of the first and second upper boxes above the respective first and second lower boxes so that each of the upper roller apparatuses contact the mast section and lift the lower end of the mast section off the mover so that the mast section is supported by the upper roller apparatuses and a mast roller apparatus, after lifting the lower end of the mast section off the mover, rolling the mast section on the upper roller apparatuses so as to further move the mast section relative to the mover and position the lower end of the mast section over the lower roller apparatuses, after positioning the lower end of the mast section over the lower roller apparatuses, lowering the upper boxes so that the mast section rests on the lower roller apparatus, after lowering the upper boxes, moving the mast section along the substructure by rolling the mast section on both the upper and lower roller apparatuses so as to align the mast feet with the mast shoes, and connecting the mast feet to the mast shoes.

15. The method of claim 1, wherein the first and second laterally spaced-apart substructure boxes define an open area therebetween that is adapted to receive at least a portion of the mover therein, the method further comprising moving a portion of the mover into the open area prior to lifting the lower end of the mast section off the mover.

16. The method of claim 1, wherein positioning the lower end of the mast section over each of the upper roller apparatuses comprises positioning at least part of the lower end between the first and second upper boxes.

17. The method of claim 1, further comprising, after lifting the lower end of the mast section off the mover, moving the mast section along the substructure by rolling the mast section on each of the upper and lower roller apparatuses while the mast section is in a substantially horizontal position.

18. A mast erection apparatus, comprising:

a substructure, comprising:

a first side substructure box comprising a first lower box and a first upper box that is adapted to be raised above the first lower box; and a second side substructure box that is adapted to be positioned adjacent to and laterally spaced-apart from the first side substructure box, the second side substructure box comprising a second lower box and a second upper box that is adapted to be raised above the second lower box, wherein the first and second laterally spaced-apart side substructure boxes define an open space therebetween that is adapted to receive at least a portion of a mast section and at least a portion of a mover that is used to move the mast section between the first and second laterally spaced-apart side substructure boxes during a mast erection operation;

first and second upper roller apparatuses coupled to the first and second upper boxes, respectively, wherein the first and second upper roller apparatuses are adapted to support at least a lower end of the mast section during the mast erection operation when the lower end is lifted off the mover after the mover has moved the mast section between the first and second laterally spaced-apart side substructure boxes and after at least said portions of the mast section and the mover have been received by the open space; and first and second lower roller apparatuses coupled to the first and second lower boxes, respectively, wherein the first and second upper and lower roller apparatuses are adapted to facilitate a rolling movement of the mast section along the substructure after the lower end of the mast section has been lifted off the mover.

19. A mast erection apparatus of claim 18, wherein the first and second upper roller apparatuses are pivotably coupled to the first and second upper boxes, respectively, each of the pivotably coupled first and second upper roller apparatuses being adapted to be pivoted from a first roller position to a second roller position for supporting the mast section.

20. A mast erection apparatus of claim 18, wherein the first and second lower roller apparatuses are pivotably connected to the first and second lower boxes, respectively, each of the pivotably connected first and second lower roller apparatuses being adapted to be pivoted from a first roller position to a second roller position for supporting the mast section.

21. A mast erection apparatus of claim 18, further comprising a mast roller apparatus that is adapted to facilitate a rolling movement of the mast section relative to the mover.

22. A mast erection apparatus of claim 18, further comprising an upper box raising apparatus that is adapted to raise the first and second upper boxes above the respective first and second lower boxes so as to lift the lower end of the mast section off the mover.

23. A mast erection apparatus of claim 18, further comprising a mast raising apparatus that is adapted to raise an upper end of the mast section off the mover after the lower end of the mast section has been lifted off the mover and after the mast section has been rolled along the substructure on both the first and second upper and lower roller apparatuses.

24. A mast erection apparatus, comprising:

a substructure, comprising:

a first side substructure box comprising a first lower box and a first upper box that is adapted to be raised above the first lower box; and a second side substructure box that is adapted to be positioned adjacent to and laterally spaced-apart from the first side substructure box, the second side substructure box comprising a second lower box and a second upper box that is adapted to be raised above the second lower box;

first and second upper roller apparatuses pivotably coupled to the first and second upper boxes, respectively, wherein each of the first and second upper roller apparatuses is adapted to be pivoted from a first roller position to a second roller position so as to support at least a lower end of a mast section during a mast erection operation when the lower end is lifted off a mover that is used to move the mast section adjacent to the substructure; and first and second lower roller apparatuses coupled to the first and second lower boxes, respectively, wherein the first and second upper and lower roller apparatuses are adapted to facilitate a rolling movement of the mast section along the substructure after the lower end of the mast section has been lifted off the mover.

25. A mast erection apparatus, comprising:

a substructure, comprising:

a first side substructure box comprising a first lower box and a first upper box that is adapted to be raised above the first lower box; and a second side substructure box that is adapted to be positioned adjacent to and laterally spaced-apart from the first side substructure box, the second side substructure box comprising a second lower box and a second upper box that is adapted to be raised above the second lower box;

first and second upper roller apparatuses coupled to the first and second upper boxes, respectively, wherein the first and second upper roller apparatuses are adapted to support at least a lower end of a mast section during a mast erection operation when the lower end is lifted off a mover that is used to move the mast section adjacent to the substructure; and first and second lower roller apparatuses pivotably connected to the first and second lower boxes, respectively, wherein each of the first and second lower roller apparatuses is adapted to be pivoted from a first roller position to a second roller position for supporting the mast section and wherein the first and second upper and lower roller apparatuses are adapted to facilitate a rolling movement of the mast section along the substructure after the lower end of the mast section has been lifted off the mover.

* * * * *